US007785143B2

(12) United States Patent
Zhang et al.

(10) Patent No.: US 7,785,143 B2
(45) Date of Patent: Aug. 31, 2010

(54) COAXIAL CONNECTOR HAVING MOVABLE TERMINAL

(75) Inventors: Xiao-Guo Zhang, Kunshan (CN); Qing-Man Zhu, Kunshan (CN); Chien-Chiung Wang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/432,771

(22) Filed: Apr. 30, 2009

(65) Prior Publication Data

US 2009/0275233 A1 Nov. 5, 2009

(30) Foreign Application Priority Data

Apr. 30, 2008 (CN) ..... 2008 2 0035882

(51) Int. Cl.
*H01R 9/05* (2006.01)

(52) U.S. Cl. ..... 439/578; 439/583

(58) Field of Classification Search ..... 439/578, 439/583, 584, 585

See application file for complete search history.

(56) References Cited

U.S. PATENT DOCUMENTS

| | | | | |
|---|---|---|---|---|
| 6,332,815 | B1 * | 12/2001 | Bruce | 439/862 |
| 6,692,286 | B1 * | 2/2004 | De Cet | 439/352 |
| 6,780,051 | B2 * | 8/2004 | Otsu | 439/578 |
| 7,478,475 | B2 * | 1/2009 | Hall | 29/869 |
| 7,556,529 | B2 * | 7/2009 | Wakamatsu et al. | 439/578 |

FOREIGN PATENT DOCUMENTS

| | | |
|---|---|---|
| TW | M328713 | 3/2008 |

* cited by examiner

*Primary Examiner*—Thanh-Tam T Le
(74) *Attorney, Agent, or Firm*—Ming Chieh Chang; Wei Te Chung; Andrew C. Cheng

(57) ABSTRACT

A coaxial connector (1) having a moveable terminal includes a metallic bracket (10) defining a receiving space (100) therein. A contact terminal (20) is insulated assembled to the bracket and configured a stationary first part (31) and a second part (33) telescopically assembled within the first part.

3 Claims, 5 Drawing Sheets

COAXIAL CONNECTOR HAVING MOVABLE TERMINAL

BACKGROUND OF THE INVENTION

1. Field of the Invention

The present invention relates to a coaxial connector for electrically connecting with a printed circuit board, and more particularly to a coaxial connector having a movable terminal for adjusting the distance between the coaxial connector and the printed circuit board.

2. Description of the Prior Art

Taiwanese Utility Patent No. M328713 issued to SHIH on Mar. 11, 2008 discloses a coaxial connector for electrically connecting with a printed circuit board. The coaxial connector includes a terminal having a first part and a second part. The first part has a front mating portion and a rear receiving socket having a tubular inner surface. The second part is received in the rear receiving socket and extends outwardly from the receiving socket. The second part has a substantially cylindrical surface abutting against the tubular inner surface of the rear receiving socket. The rear receiving socket also has a protruding portion resisting against the inserted portion.

Distances between the coaxial connector and the printed circuit board vary from one another, therefore it is necessary that the extension of the contact terminal thereof can be adjusted to fit the actual requirements. Without such an adaptability, it would be difficult to have the coaxial connector mounted to the printed circuit board if the extension is too short to meet the requirement.

Hence, an improved coaxial connector is needed to solve the above problem.

BRIEF SUMMARY OF THE INVENTION

An object of the present invention is to provide a coaxial connector in which a movable contact terminal is incorporated such that the contact terminal can be readily adjusted so as to meet different field requirement.

In order to achieve the object set forth, a coaxial connector having a movable terminal made in according with the present invention includes a metallic bracket defining a receiving space therein. A contact terminal is insulated assembled to the bracket and configured a stationary first part and a second part telescopically assembled within the first part.

The rear receiving socket of the first part has robust space for the movement of the engagement portion of the second part. The second part is moveable in the rear receiving socket of the first part for adjusting the length of the contact terminal. Therefore, when assembling the coaxial connector to a printed circuit board of different equipment or apparatus, the distance between the coaxial connector and the printed circuit board is adjustable so as to fit the field requirements.

Other objects, advantages and novel features of the invention will become more apparent from the following detailed description of the present embodiments when taken in conjunction with the accompanying drawings.

DETAILED DESCRIPTION OF THE INVENTION

Figure 1:
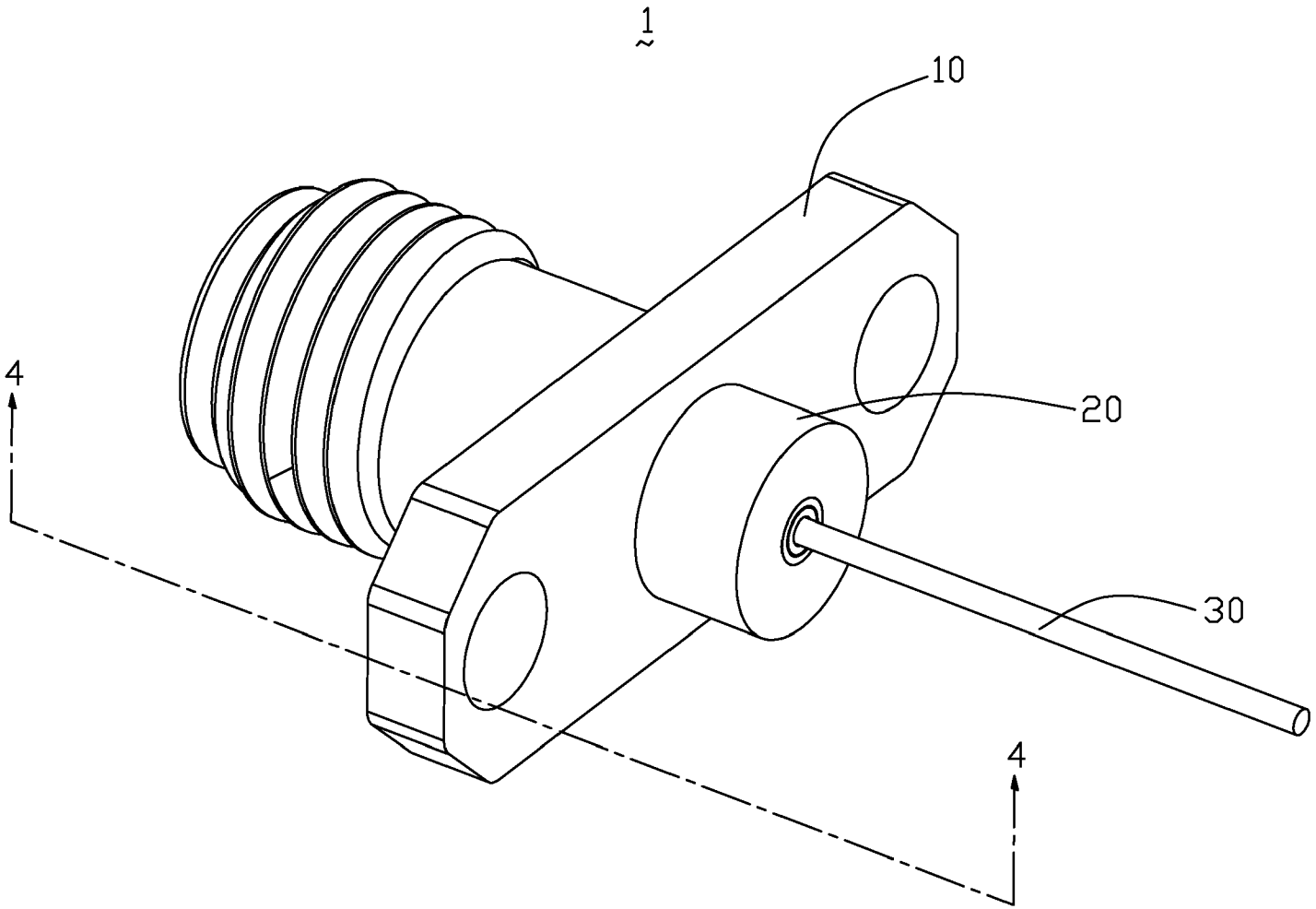
FIG. 1 is an assembled perspective view of a coaxial connector.
Figure 2:
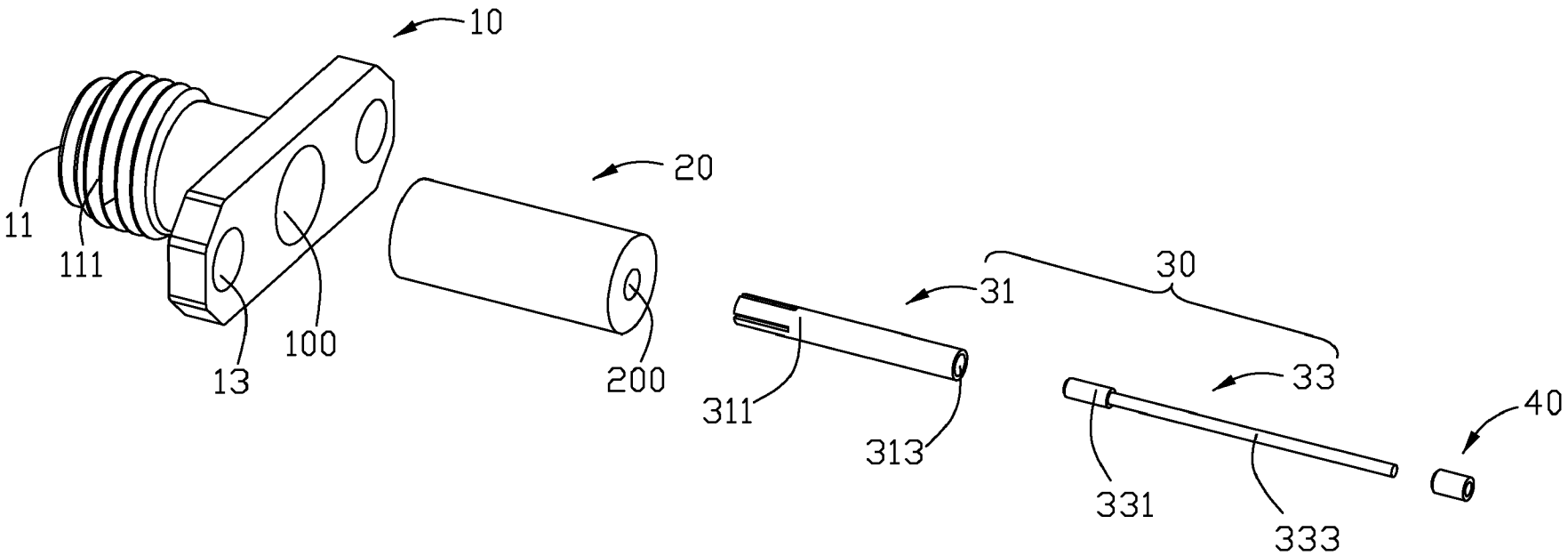
FIG. 2 is an exploded view of the coaxial connector as shown in FIG. 1.
Figure 3:
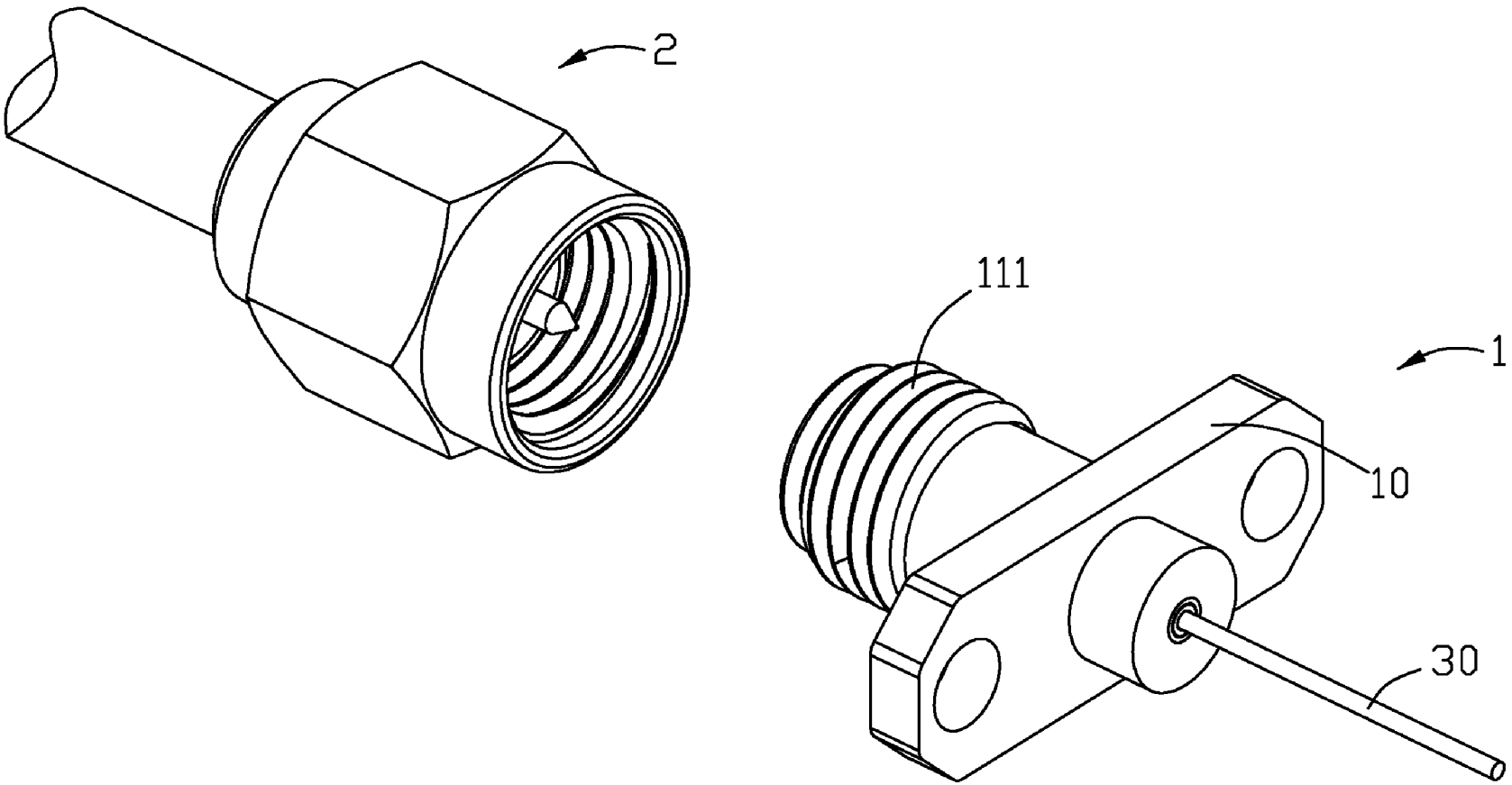
FIG. 3 is a perspective view of the coaxial connector exploded from a corresponding plug.
Figure 4:
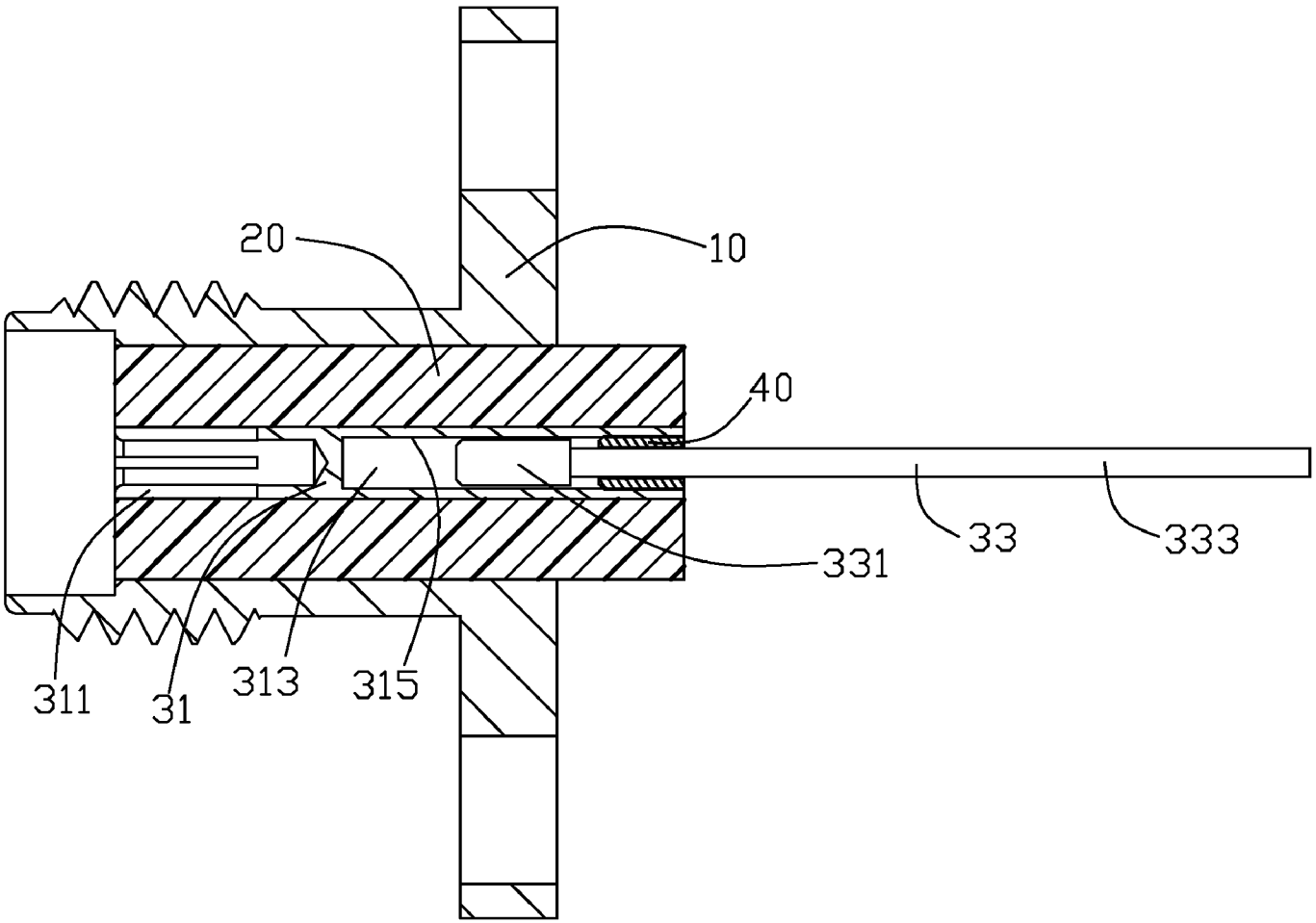
FIG. 4 is a cross-sectional view of the coaxial connector as shown in FIG. 1 taken along line 4-4.
Figure 5:
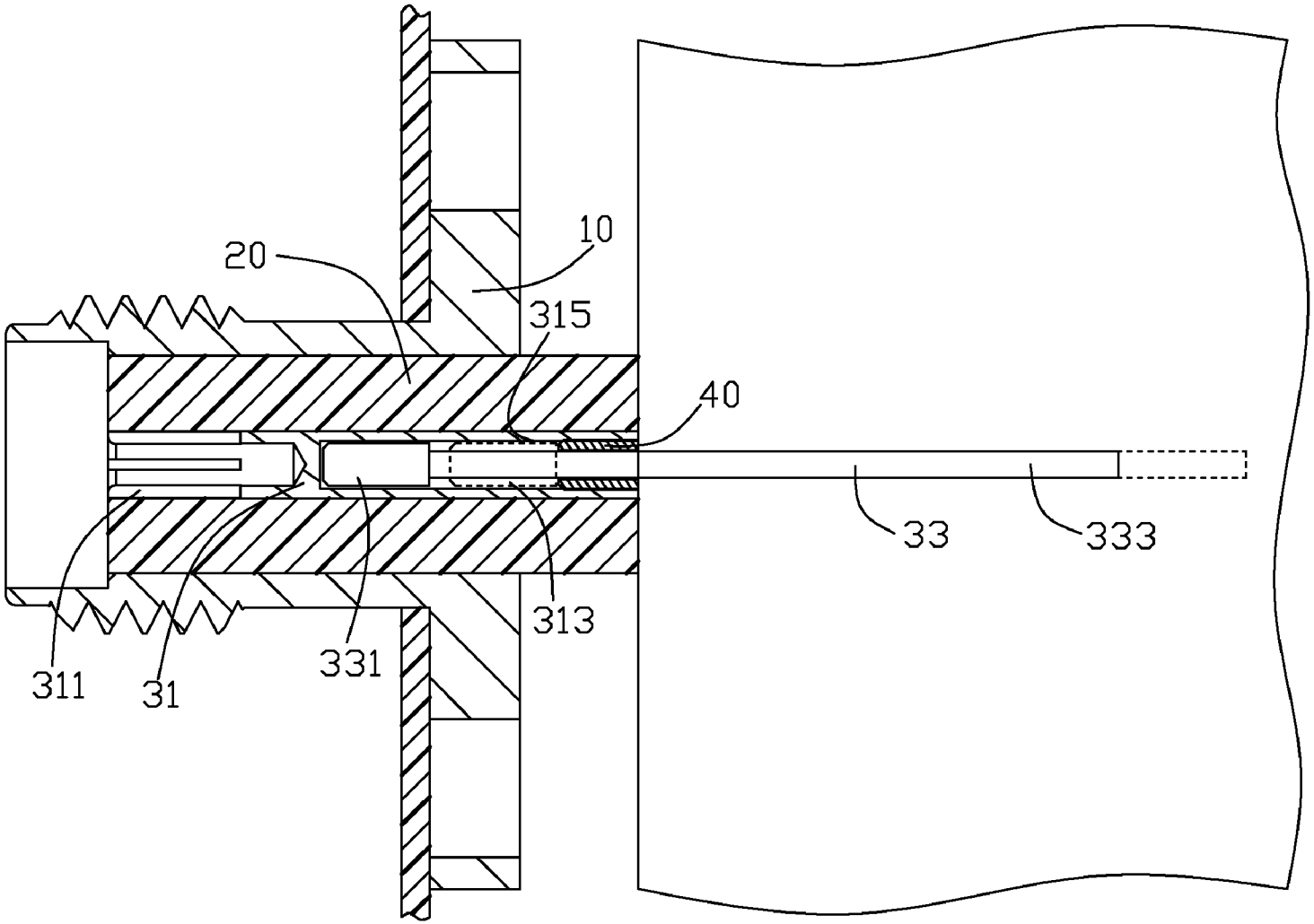
FIG. 5 is a cross-sectional view of the coaxial connector as shown in FIG. 1 when the coaxial connector is mounted on a panel and electrically connected to a printed circuit board.

Reference will now be made to the drawing figures to describe the present invention in detail. Referring to FIGS. 1-5, a coaxial connector 1 mounted on a panel (not labeled) and then electrically connected to a printed circuit board (not labeled) includes an bracket 10, an insulative member 20 received in the bracket 10, a contact terminal 30 received in the insulative member 20 and a collar 40 surrounding the contact terminal 30.

Referring to FIGS. 1-3 and 5, the bracket 10 is made of metallic material and has a main portion 11 and a rear shoulder portion 13 for mounting on the panel. The bracket 10 has a cylindrical shape and has a receiving space 100 extending therethrough for receiving the insulative member 20. The main portion 11 has external threads 111 for receiving a corresponding plug 2 thereon.

The insulative member 20 is firmly assembled in the receiving space 100 of the outer conductive member 10 by interferential engagement with the inner surface of the outer conductive member 10. The insulative member 20 has a hole 200 extending therethrough for receiving the contact terminal 30.

Referring to FIGS. 2-5, the contact terminal 30 is configured with a first part 31 and a second part 33. The first part 31 is received in the hole 200 of the insulative member 20. The first part 31 has a cylindrical shape and extends along an axial direction. The first part 31 has a front mating portion 311 defined in a front end thereof for electrical interconnection with the corresponding plug 2. The first part 31 further has a rear receiving socket 313 defined in a rear end thereof for telescopically receiving the second part 33 therein. The rear receiving socket 313 has a tubular inner surface 315 having a first length.

The second part 33 has an engagement portion 331 inserted into the rear receiving socket 313, and a tail portion 333 extends from the engagement portion 331. The engagement portion 331 is of a cylindrical shape and has a first diameter and a second length less than the first length. The tail portion 333 is of a cylindrical shape and has a second diameter less than the first diameter of the engagement portion 331. The engagement portion 331 abuts against the tubular inner surface 315 so as to keep a constant electrical connection therebetween and is moveable along the axial direction. The tail portion 333 extends outwardly from the rear receiving socket 313 for electrically connecting to the printed circuit board.

The collar 40 surrounds the tail portion 333 and interferes with the tubular inner surface 315 of the rear receiving socket 313. The champing ring 40 could prevent the second part 33 from moving out from the first part 31.

The rear receiving socket 313 of the first part 31 has robust space for movement of the engagement portion 331 of the second part 33 because the first length of the tubular inner surface 315 is longer than the second length of the engagement portion 331. The second part 33 is moveable in the rear receiving socket 313 of the first part 31 for adjusting the length of the contact terminal 30. Therefore, when assembling the coaxial connector 1 to different equipment or apparatus (not shown), it is easy to adjust the extension of the element 33 with respect to a conductive trace of the printed circuit board.

It is to be understood, however, that even though numerous, characteristics and advantages of the present invention have been set fourth in the foregoing description, together with details of the structure and function of the invention, the disclosed is illustrative only, and changes may be made in detail, especially in matters of number, shape, size, and arrangement of parts within the principles of the invention to the full extent indicated by the broad general meaning of the terms in which the appended claims are expressed.

What is claimed is:

1. A coaxial connector having a moveable terminal, comprising:

a metallic bracket defining a receiving space therein;

a contact terminal insulated assembled to the bracket, and configured a stationary first part and a second part telescopically assembled within the first part, said first part of the contact terminal defining thereon a mating interface for mating with a complementary connector, said second part of the contact terminal located behind said mating interface and restricted in movement behind said mating interface;

wherein said first part of the contact terminal has a cylindrical shape extending along an axial direction comprising a front mating portion and a rear receiving socket for receiving the second part;

wherein said rear receiving socket of the first part has a tubular inner surface having a first length along the axial direction;

wherein said second part of the contact terminal comprises an engaging portion received in the rear receiving socket and a tail portion extending from the engaging portion and outwardly from the rear receiving socket;

wherein said engaging portion of the second part has a second length less than the first length, the engaging portion abutting against the tubular inner surface of the rear receiving socket and movable along the axial direction;

wherein the coaxial connector further comprises a collar surrounding the tail portion of the second part, interfering with the tubular inner surface of the rear receiving socket and locating at a rear end of the first part; and wherein said bracket comprises a main portion having external threads for receiving a corresponding plug thereon and a rear shoulder portion for mounting on a panel.

2. The coaxial connector as claimed in claim 1, further comprising an insulative member received in the receiving space, the insulative member having a hole for receiving the first part of the contact terminal.

3. A coaxial connector comprising:

a contact terminal, an insulative member and a metallic bracket fully circumferentially surrounding one another in sequence;

the contact terminal including a first part and a second part under condition that the first part defines a mating section for mating with a complementary connector and the second part defines the mounting section for mounting to an external part on which at least one of said bracket and said insulative member is seated;

said insulative member being immovably engaged within the bracket, said first part being immovably engaged within the insulative member while said second part being moveably engaged with the first part along an axial direction; wherein a distance between the mating section and the mounting section is variant due to movement of the second part relative to the first part;

wherein the coaxial connector further comprises a collar located at a rear end of the first part;

wherein said collar is located at a rear end of the insulative member;

wherein a front portion of said second part is located inside said first part radially;

wherein said insulative member is seated upon the external part; and wherein said bracket comprises a main portion having external threads for receiving a corresponding plug thereon and a rear shoulder portion for mounting on a panel.

* * * * *